United States Patent [19]

Dooley, Jr. et al.

[11] Patent Number: 4,572,545

[45] Date of Patent: Feb. 25, 1986

[54] SKI-POLE HAND SHIELD

[76] Inventors: John C. Dooley, Jr., 27 Curtis Pl.; Richard Pikulski, 139 Beechwood Ave., both of Staten Island, N.Y. 10301

[21] Appl. No.: 505,212

[22] Filed: Jun. 17, 1983

[51] Int. Cl.[4] ..... A63C 11/22

[52] U.S. Cl. ..... 280/821; 2/16; 135/72

[58] Field of Search ..... 280/821; 403/344; 294/58, 57; 2/16, 17; 135/72, 75, 76; D8/DIG. 6

[56] References Cited

U.S. PATENT DOCUMENTS

| | | | |
|---|---|---|---|
| 568,024 | 9/1896 | Gorman | 2/17 |
| 3,746,356 | 7/1973 | Shipstad | 280/821 |
| 3,832,912 | 9/1974 | Edwards | 2/17 |
| 3,874,686 | 4/1975 | Shipstad et al. | 280/821 |
| 3,879,048 | 4/1975 | Penney | 280/821 |
| 4,343,490 | 8/1982 | Adamson | 280/821 |

FOREIGN PATENT DOCUMENTS

| | | | |
|---|---|---|---|
| 2357662 | 5/1975 | Fed. Rep. of Germany | 280/821 |
| 2294725 | 7/1976 | France | 280/821 |

*Primary Examiner*—Joseph F. Peters, Jr.
*Assistant Examiner*—Mark C. Dukes
*Attorney, Agent, or Firm*—Stefan J. Klauber

[57] ABSTRACT

A shield used in combination with a ski pole having an axis-defining shaft terminating at an upper end in a grip. The grip has a main body with a tubular mounting part generally centered on the axis and fitted around the ski pole adjacent the grip thereof and an axially upwardly open U-section guard flaring upward and radially outward from the mounting part. The guard surrounds the grip at a spacing sufficient for a hand to engage around the grip within the guard. Screw fasteners are provided for rigidly securing the mounting part on the ski pole. The mounting part includes a U-section main piece and a separate minor piece fittable therewith. The fasteners engage through the pieces to clamp same to the shaft.

14 Claims, 5 Drawing Figures

FIG-3
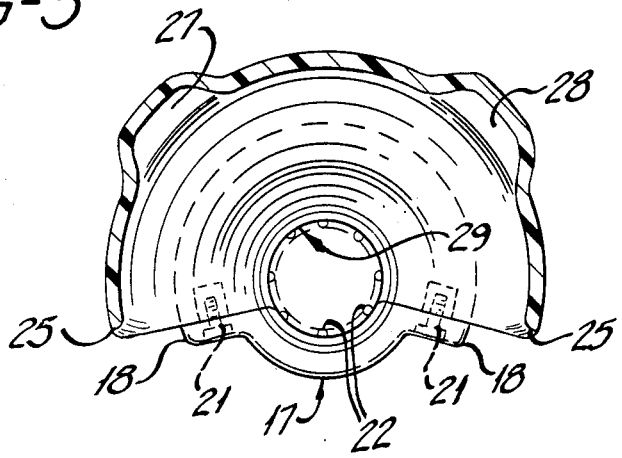
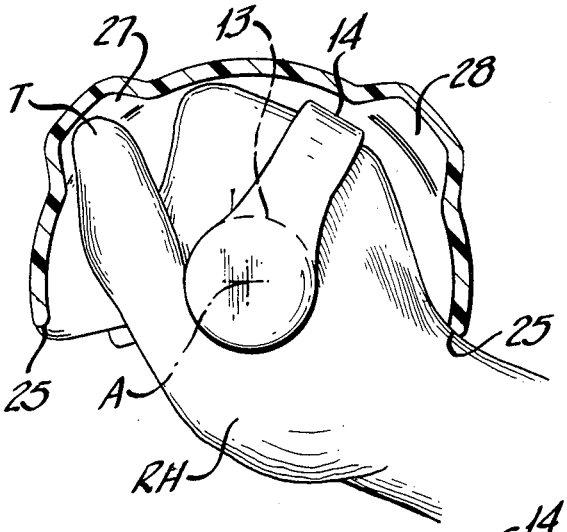
FIG-4
FIG-5
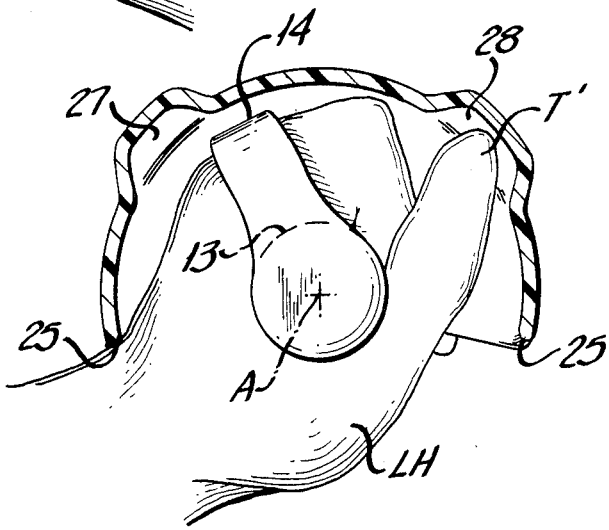

SKI-POLE HAND SHIELD

FIELD OF THE INVENTION

The present invention relates to a ski-pole hand shield.

BACKGROUND OF THE INVENTION

Physicians and other concerned individuals have in recent years come to appreciate that finger fractures and especially fractures and other injuries to the thumbs, are among the most common serious injuries sustained by skiers in accidents. The reason for this is that the skier normally grips his ski poles in such manner that the thumbs protrude in the direction of the skier's advance, and since the hands are not readily disengaged upon a fall or impact, the thumbs often bear the brunt of the impact.

Prior known devices have not successfully addressed this problem. It is thus known, as for example from U.S. Pat. Nos. 3,746,356 and 3,874,686 of Shipstad to provide a hand shield on the top of a ski pole. This shield is formed as a semirigid blind tube whose closed end forms a deep pocket in which the skier's hand and wrist can fit with some play. The ski-pole grip extends transversely across the interior of the shield slightly back of its closed front end, so the hand can hold this grip. The ski pole therefore extends transversely away from this shield. The principal function of this device, however, is to deflect wind from the skier's hand. It is not actually adapted to protect the skier from the aforementioned dangers.

Further, these items are fairly bulky when in use so that they make smart maneuvering difficult. Storage of skis equipped with them is also quite inconvenient, in particular on a roof rack where ski poles will need more space than the skis. In an accident it is also possible for a hand to get twisted inside the shield and be injured by the shield or by an attempt to free it from the shield.

OBJECTS OF THE INVENTION

It is therefore an object of the present invention to provide an improved ski-pole hand shield.

Another object is the provision of such a ski-pole hand shield which overcomes the above-given disadvantages, that is which is relatively compact, but which protects the user from harm while never posing a risk in itself to the skier.

SUMMARY OF THE INVENTION

These objects are attained according to the instant invention in a shield used in combination with a ski pole having an axis-defining shaft terminating at an upper end in a grip. The shield according to the invention has a main body having a tubular mounting part generally centered on the axis and fitted around the ski pole adjacent the grip thereof, and an axially upwardly open U-section guard flaring upward and radially outward from the mounting part. The guard surrounds the grip at a spacing sufficient for a hand to engage around the grip within the guard. Means, normally screw fasteners, are provided for rigidly securing the mounting part on the ski pole.

This upwardly open shape makes it possible for the guard to fit the user's hand relatively closely in the critical front part where the knuckles and finger tips are exposed, while still offering plenty of clearance for substantial movement of the forearm relative to the pole. Taking and releasing hold of the grips of poles equipped with the shield according to this invention is no more difficult than without these shields. In addition, poles equipped with such shields are compact enough that they can be transported easily, since the shields are no larger than the snow baskets on the bottom ends of the same poles.

According to another feature of this invention the mounting part includes a U-section main piece and a separate minor piece fittable therewith. The fasteners engage through the pieces to clamp same to the shaft. In addition the mounting part is formed with radially inwardly extending grip-enhancing projections engaging the shaft. Such construction makes it easy to fit the shields solidly to the ski pole, and provides such a solid mounting that they can be forgotten once installed, needing no special care or periodic servicing.

The upper rim of the guard according to this invention lies generally in a plane perpendicular to the axis. Furthermore the guard is formed below its upper rim with a pair of angularly offset and inwardly open recesses positioned to receive the thumb tip of a respective hand engaged around the respective grip. The shield is symmetrical about a plane passing through the axis and extending midway between the recesses.

The parts of the shield according to this invention are unitarily formed of a stiff synthetic resin, with the guard being of substantially thinner wall thickness than the mounting part. The shield can therefore be made at low cost and is completely weatherproof.

DESCRIPTION OF THE DRAWING

The above and other features and advantages will become more readily apparent from the following, reference being made to the accompanying drawing in which:

FIG. 3 is a section taken along line 3—3 of FIG. 1; and

FIGS. 4 and 5 are views like FIG. 3, but showing the system in right- and left-hand use, respectively.

DESCRIPTION OF PREFERRED EMBODIMENT

Figure 1:
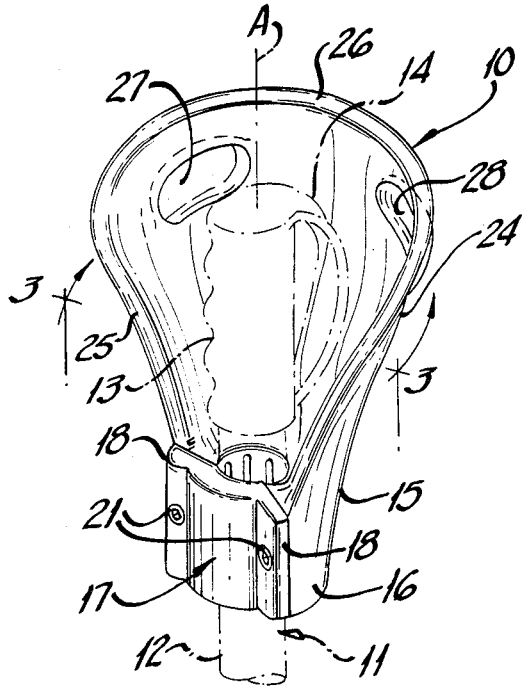
FIG. 1 is a perspective view of the shield and ski pole according to this invention.
Figure 2:
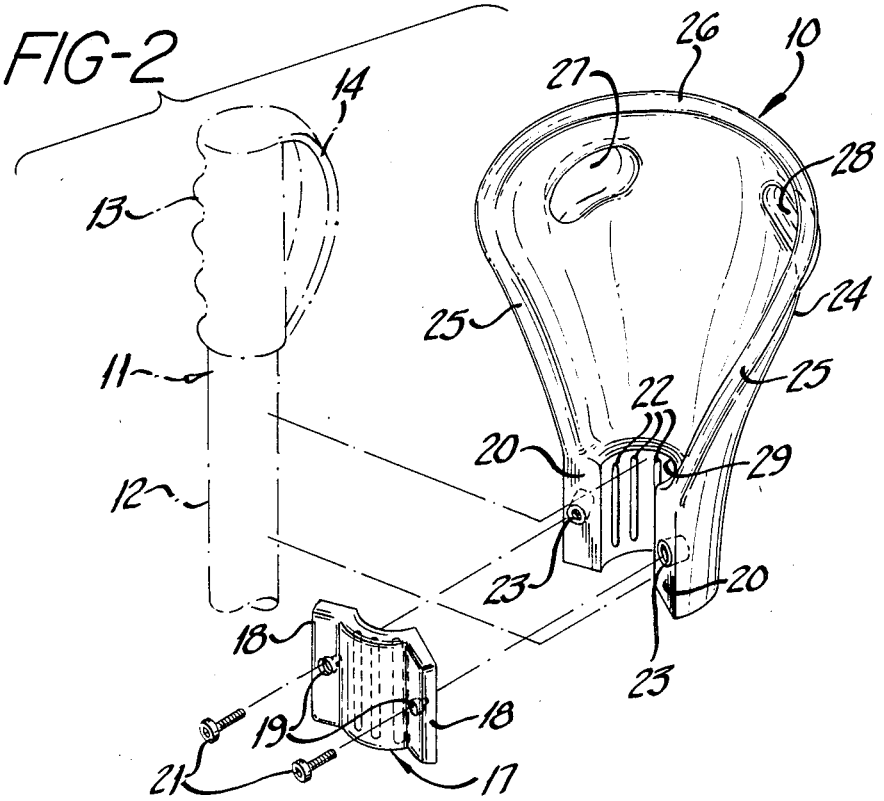
FIG. 2 is an exploded view of the structure of FIG. 1.

As seen in FIGS. 1 and 2 a shield 10 according to the invention is made to be mounted on a ski pole 11 having a tubular cylindrical shaft 12 defining an axis A, an elastomeric grip 13 at the upper end of this shaft 12, and a loop 14 extending from the top of the grip 13. (In other instances, as is known, a looped strap may be provided at the top of grip 13.)

The shield 10 has a tubular lower part 15 of relatively great wall thickness and cylindrical shape, and in turn formed by a main piece 16 and a minor piece 17. The main piece 16 defines an arced gripping portion 29 which extends well over 180° around the pole. The minor piece 17 which cooperates with piece 16 has a pair of lateral wings 18 that are formed with throughgoing holes 19 so they can be bolted to faces 20 of the main piece 16 by means of cap screws 21. Internally the two pieces 16 and 17 are formed with axially extending ribs 22. It would also be within the scope of this invention to provide other grip-enhancing formations such as horizontal ribs, nubs, or the like. The main piece 16 is formed of a limited flexible synthetic resin that is sufficiently deformable that it can be opened up and gripped around the shaft 12, in which case threaded metallic liners 23 are needed opening at the faces 20 to receive the metallic (or plastic) screws 21. The piece 17 may be of a substantially harder material.

In some instances, depending upon the specific materials comprising piece 16 and the dimensions of same in comparison to the ski pole, it may be unnecessary to provide a cooperating piece 17. Thus, the piece 16 may have sufficient inherent resiliency, that the arced gripping portion 29 will so tightly grasp the ski pole, that the cooperating piece 17 can be dispensed with.

Above, that is axially upward in FIGS. 1 and 2, the thick lower piece 16, the shield 10 has a thinner and upwardly flared guard 24 that is of U-section. As also shown in FIG. 3 this guard 24 has two rearwardly directed edges 25 defining planes forming an angle of about 155° with each other, and meeting at a line slightly behind but parallel to the axis A. In addition the guard 24 has an upper edge or rim 26 lying generally in a plane perpendicular to the axis A. The guard 24 and main piece 16 are integrally formed of a limitedly elastic and stiff synthetic resin.

In order that the user's hand RH or LH shown in FIGS. 4 and 5 can fit comfortably between the guard 24 and grip 13, the guard is formed adjacent its rim 26 (which rim is rounded or "beaded") with two radially inwardly open recesses 27 and 28 that are slightly elongated in a plane perpendicular to the axis A. The recess 27 receives the tip T of a right hand RH and the recess 28 the thumb tip T' of a left hand LH. The entire shield is symmetrical about a plane including the axis A and angularly equidistant between the recesses 27 and 28.

The shield 10 according to this invention therefore will snugly and comfortably shield the skier's hand both from wind and, more importantly, from physical injury. The fingers and knuckles are well protected without being encumbered, while at the same time in the event of a fall the user can drop the grip 13 and release the ski pole, which will of course remain tethered by the loop 14. Even during sharp maneuvering the user's hands will be free to twist and pivot on the grips 13 without regard to the shield, unlike the prior art systems which required the forearm to remain substantially perpendicular to the ski pole.

When not in use the guard 10 is so constructed that it allows two poles to fit snugly together, since two rims 25 lie generally in a plane with the 17 mm–18 mm diameter pole 11. Thus the shafts of two poles can lie against each other with the two shields cupped toward one another and their rims 25 virtually engaging each other, creating no more hindrance than the baskets at the opposite ends of the poles.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

We claim:

1. For use with a ski pole having an axis-defining shaft terminating at an upper end in a grip; a hand shield comprising:

a main body having a mounting part including an arced gripping portion at its lower end which is generally centered on the axis and securable around the ski pole adjacent and below the grip thereof, and an axially upwardly open U-section guard flaring upward and radially outward from the mounting part, the guard surrounding the grip at a spacing sufficient for a hand to engage around the grip within the guard; said guard being formed with a pair of angularly offset and inwardly open recesses positioned to receive the thumb tip of a respective hand engaged around the respective grip; said mounting part being generally tubular and including a U-section main piece and a separate minor piece fittable therewith, fasteners engaging through the pieces to clamp same to the shaft of the said ski pole.

2. The ski-pole hand shield defined in claim 1 wherein the mounting part is formed with radially inwardly extending grip-enhancing projections engaging the shaft.

3. The ski-pole hand shield defined in claims 1 wherein the fasteners are screws.

4. The ski-pole hand shield defined in claim 1, wherein the upper rim of the guard lies generally in a plane perpendicular to the axis.

5. The ski-pole hand shield defined in claim 1 wherein the shield is symmetrical about a plane passing through the axis and extending midway between the recesses.

6. The ski-pole hand shield defined in claim 1, wherein the parts are unitarily formed of a stiff synthetic resin.

7. The ski-pole hand shield defined in claim 5 wherein the guard is of substantially thinner wall thickness than the mounting part.

8. For use with a ski pole having an axis-defining shaft terminating at an upper end in a grip; a hand shield comprising:

a main body formed of a stiff synthetic resin, and having a mounting part including an arced gripping portion at its lower end which is generally centered on the axis and securable around the ski pole adjacent and below the grip thereof, and an axially upwardly open U-section guard flaring upward and radially outward from the mounting part, the guard surrounding the grip at a spacing sufficient for a hand to engage around the grip within the guard, the said guard being formed with a pair of angularly offset and inwardly open recesses positioned to receive the thumb tip of a respective hand engaged about the respective grip, the flaring U-section portion of the guard forming a complete protective barrier about the user's knuckles and thumb tip upon the user grasping the ski-pole grip, and the rearwardly facing opening of the flaring U-section permitting the user's hand to twist and pivot on the grip without regard to the shield.

9. The ski-pole hand shield defined in claim 8, wherein the mounting part is generally tubular and includes a U-section main piece and a separate minor piece fittable therewith, fasteners engaging through the pieces to clamp same to the shaft of the said ski pole.

10. The ski-pole hand shield defined in claim 8, wherein the mounting part is formed with radially inwardly extending grip-enhancing projections engaging the shaft.

11. The ski-pole hand shield defined in claim 9 wherein the fasteners are screws.

12. The ski-pole hand shield defined in claim 8, wherein the upper rim of the guard lies generally in a plane perpendicular to the axis.

13. The ski-pole hand shield defined in claim 8, wherein the shield is symmetrical about a plane passing through the axis and extending midway between the recesses.

14. The ski-pole hand shield defined in claim 13, wherein the guard is of substantially thinner wall thickness than the mounting part.

* * * * *